United States Patent [19]

Widerman, Jr.

[11] Patent Number: 4,853,042

[45] Date of Patent: Aug. 1, 1989

[54] PROCESS FOR REMOVING ASBESTOS OR OTHER FRIABLE COATING FROM A SURFACE

[75] Inventor: John W. Widerman, Jr., Baltimore, Md.

[73] Assignee: General Maintenance Company, Inc., Cockeysville, Md.

[21] Appl. No.: 67,242

[22] Filed: Jun. 29, 1987

[51] Int. Cl.[4] ..... B08B 1/00

[52] U.S. Cl. ..... 134/6; 15/93 R; 15/93 C; 15/159 A; 15/160; 15/209 C; 15/209 D; 15/227; 134/10; 134/42

[58] Field of Search ..... 134/6, 10, 42; 15/227, 15/93 R, 93 C, 209 D; 98/115.1, 15.3; 128/1 R, 1 B

[56] References Cited

U.S. PATENT DOCUMENTS 3,969,090 7/1976 Sasena et al. ..... 15/159 A
4,479,277 10/1984 Gilman et al. ..... 15/160

OTHER PUBLICATIONS

Division of Environmental Disease Control, Maryland Department of Health and Mental Hygiene, "Recommended Contract Specifications for Asbestos Abatement Projects," three pages.

National Institute of Building Sciences, "Model Guide Specifications Asbestos Abatement in Buildings," pp. 1–7 (1986).

Control Resource Systems, Inc. brochure, "Asbest-O-Saf/Sac," two pages.

ACTI brochure, "Bear Claw Wire Brush Glove," 1 page (1986).

*Primary Examiner*—Asok Pal
*Attorney, Agent, or Firm*—Spencer & Frank

[57] ABSTRACT

A process for removing a friable coating is particularly useful to remove residues remaining after an asbestos coating has been scraped from a surface in a building. Workmen remove such residues from flat or moderately contoured surfaces by scrubbing them with rubberized fiber pads cut from a sheet of commercially available packing material. Wire brushes are used only for detail or clean-up work. The use of rubberized fiber pads in lieu of wire brushes alone results in significant financial savings.

17 Claims, 2 Drawing Sheets

FIG. 4.
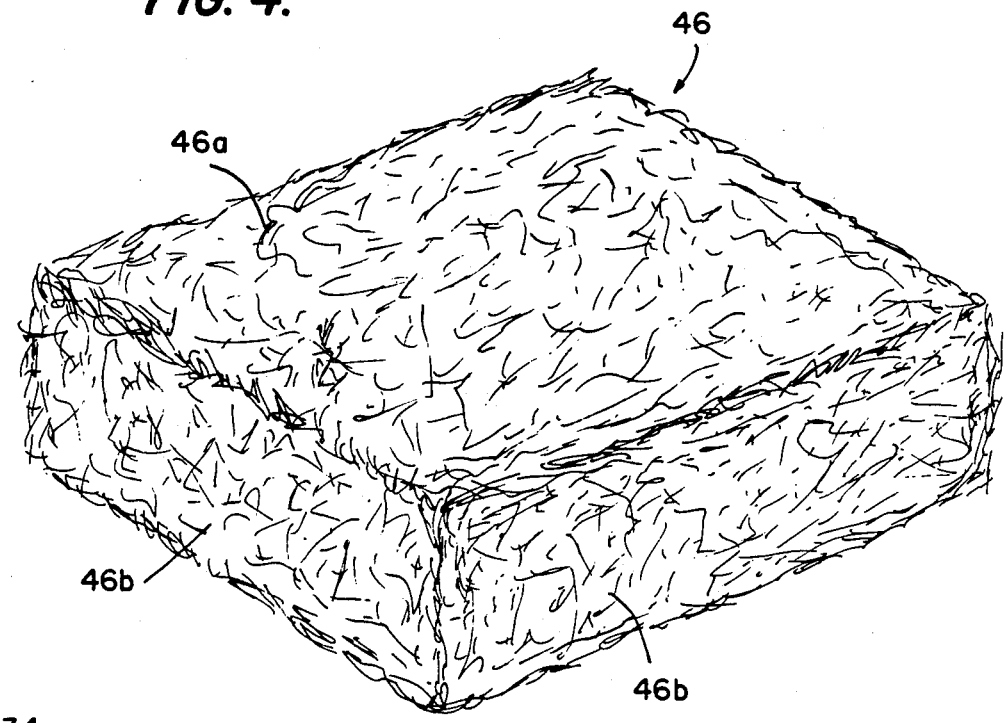
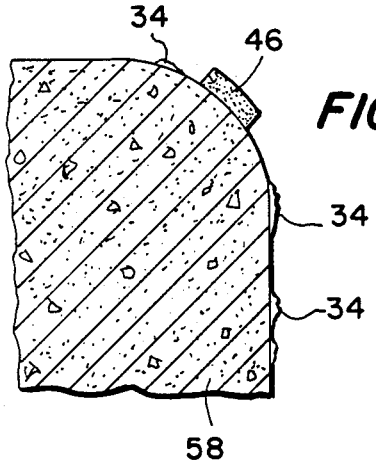
FIG. 6.
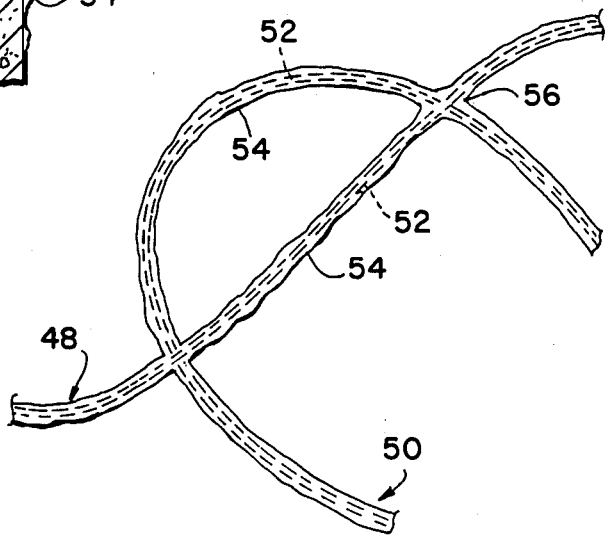
FIG. 5.

PROCESS FOR REMOVING ASBESTOS OR OTHER FRIABLE COATING FROM A SURFACE

BACKGROUND OF THE INVENTION

The present invention relates to a process for removing friable material from a surface. The invention is particularly useful for removing asbestos from buildings or other structures, although it may also be employed for removing other crumbly or loosely attached coatings such as flaking paint or rust, barnacles, and so forth.

Asbestos is a fiberous mineral material having a number of uses which have long been recognized. For example the fibers may be spun to provide an insulating cloth, or used as a filler in gaskets or tiles. At one time asbestos was used extensively in the construction industry to provide heat-resistant barriers and fire-proofing. One conventional technique was to mix the asbestos fibers with cementing material and spray the mixture on a surface to be protected, whereupon the mixture would harden to a fleecy coating of perhaps two inches thick. Such coatings were used even on concrete or metal surfaces to provide protection from the intense heat which might occur during a fire.

Unfortunately the desirable properties of asbestos were exploited in the construction industry long before its undesirable properties were appreciated. It has been found that asbestos fibers contribute to severe medical problems such as asbestosis and lung cancer. Because of this an industry has developed to remove asbestos coatings from habitable structures. A conventional removal technique will be described with reference to FIGS. 1 and 2.

In FIG. 1, an asbestos coating 10 is to be removed from ceiling 12. The area is first prepared to protect uncoated surfaces from contamination by air-borne asbestos fibers. To provide such protection FIG. 1 illustrates a plastic sheet 14 which is taped to a wall (not illustrated) adjacent ceiling 12. Thereafter the coating 10 is sprayed with a solution (such as water plus a surfactant, a mixture which is known as "amended water") to limit contamination, and is periodically re-sprayed throughout the removal process. The amended water reduces asbestos dust. A workman 16 wears a protective garment which is provided with a hood 18. Workman 16 wears a respirator (not illustrated) which is supplied with air by a breathing apparatus 20 worn on the workman's belt 22. Supported by scaffolding 24, workman 16 employs a scraper 26 to strip asbestos coating 10, which falls away in an asbestos stream 28 and is subsequently discarded. It will be apparent that a small scraper such as a putty knife, not illustrated, may be used to scrape regions too small for the scraper 26 shown in FIG. 1.

FIG. 1 illustrates a region 30 which has been scraped and a region 32 which is awaiting scraping. Although workman 16 attempts to scrap region 30 down to the bare concrete of ceiling 12, as a practical matter streaks or other regions of asbestos residue 34 almost invariably remain in region 30 after the scraping step. In the present application the step of removing patches of residue 34 will be deemed the "residue removal" step.

FIG. 2 illustrates the conventional residue removal step. In FIG. 2, ceiling 12 is supported by an I-beam 36, and patches of asbestos residue 34 remain after the scraping step has been completed. Conventionally these patches 34 are removed using an elongated wire brush 38. After the residue removal step the cleaned surfaces may be sprayed or painted with an encapsulating material (not illustrated) to trap any asbestos fibers that may remain.

In order to protect his hands from accidents during the conventional residue removal step, a workman typically uses an end row 42 of bristles to remove residue from a corner region adjacent an obstruction such as I-beam 36. Such a corner region is illustrated at 44. The use of end row 42 reduces the risk that the workman's hand might accidentally scrap against I-beam 36 during vigorous brushing, but as a result the end row 42 of bristles is the first to become bent and worn out. While the brush 38 might still be useful for large flat expanses away from obstructions, in actual practice there is a strong tendency for workmen to discard a brush 38 after its end-rows have become worn.

Another factor limiting the life of brush 38 is the wet environment in which it is used. This causes the bristles to rust and the wooden handle 40 to swell, so that the bristles tend to fall out. The net result is that a brush 38 may still have satisfactory end rows 42 of bristles when it is put away at the conclusion of work on one day, but nevertheless be discarded in favor of a new brush when the work resumes on the following day or on a Monday after a weekend.

Although the cost of brushes 38 themselves is significant, the major financial consideration in the asbestos removal industry is the cost of labor. A wire brush 38 is relatively heavy, particularly when water logged, and in view of the awkward physical stance that is frequently necessary this weight can be quite tiring. Consequently workmen generally proceed at a relatively modest pace in order to avoid exhaustion. Furthermore workmen have a tendency to brush back and forth rather than to sweep from side to side, which is more tiring and might result in an injury to the workman's hand if the hand and brush accidentally roll during a sweep. This tendency to favor brushing back and forth also limits productivity. Productivity is further reduced if the surface is a curved one, since a brush rides tangent to the curve and hence only a portion of the bristles engage the surface.

There are safety considerations in addition to these economic factors. While it would be inappropriate to deem a wire brush a safety hazard, it is nevertheless true that a wire brush may imperil a workman if he accidentally brushes against a "live" electrical fixture or wire. Furthermore the wire brushing of asbestos needlessly fragments the fibers into smaller fibers an propels them into the air. Obviously adding airborne asbestos to the environment in this way is undesirable. In addition, wire brushing may contribute to eye injuries if particles (either asbestos or rust, scale, paint chips, etc.) are "sprung" by the bristles into the workman's face. The projection of particles by a brush can also spread asbestos contamination to previously cleaned or otherwise uncontaminated areas. Finally, a wire brush may lead to disaster if it strikes sparks when used in an explosive environment.

What might be called the "bag method," not illustrated in the accompanying drawings, may be used to remove asbestos from pipes and valves. In this method plastic sheets to protect uncoated areas (e.g., sheet 14 in FIG. 1) may be omitted since the asbestos is always contained within a special bag of transparent plastic. Removal tools are placed in the bag, which is then sealed around the pipe so that a segment of the pipe is disposed within the bag. Reaching through long gloves which are provided in the bag wall, a workman uses the tools to remove the asbestos coating and to clean residue from the pipe. The asbestos falls to the bottom of the bag, which is then tied off and cut away from the remaining portion of the bag.

When the bag method is used care must be taken not to breach the integrity off the plastic bag, since a puncture would release asbestos fibers. Brushes, and particularly wire brushes, must be used with due caution to avoid such punctures.

Although wire brushes are employed extensively in the industry some authorities would prefer to avoid their use. For example the Division of Environmental Disease Control, of the Maryland Department of Health and Mental Hygiene, has published a "Recommended Contract Specifications for Asbestos Abatement Projects" which recommends that brushes have nylon or fiber bristles rather than metal bristles. Some of the problems discussed above would be ameliorated by using nylon or fiber brushes instead of wire brushes, but it will be apparent that most of the problems would remain.

SUMMARY OF THE INVENTION

Accordingly, an objective of the present invention is to provide an improved process for removing friable or flaky material from a surface, and particularly to an improved process for removing asbestos.

Another objective of the invention is to provide a process which reduces or eliminates the need for brushes and brush work when removing a friable coating from a surface.

Related objectives are to reduce the expenses associated with brushes and brush work, and to increase safety.

A further objective of the invention is to provide an improved method for removing a friable coating from a curved surface.

These and other objectives which will become apparent in the following detailed description can be attained by providing a method wherein a friable coating, or residual traces thereof after a friable coating has been scraped from a surface, are removed with a resilient pad of rubberized fibers, the term "rubberized" as used herein referring to a deposit of natural or synthetic resin which adheres to the fibers. It has been found that major portions of a surface can be cleaned more efficiently, less expensively, and safer with a rubberized fiber pad than with a wire or nylon brush, thereby relegating the brush to a secondary role as a clean-up instrument for stripping any final residue from cracks and crevices in unusual situations where a brush might be better suited to this task than a rubberized fiber pad.

Sheets of rubberized fiber material are commercially available and are used conventionally for packing, upholstery fill, shock absorption, and vibration isolation. Because of its excellent shock and vibration characteristics, the rubberized fiber material is widely used by the military as a liner for shipping containers. A sheet of rubberized fiber can be made by spraying liquid rubber or other polymer material on a tangled layer of fibers such as animal hair or plant or synthetic fibers. The thickness of the layer typically ranges from one inch to four inches, and the amount of rubber or other polymeric material that is sprayed or otherwise introduced determines the density and firmness of the product. Sheets of rubberized fiber are currently (1987) available from commercial sources in a range of thicknesses and in four degrees of firmness, and visual inspection of the firmest grade reveals almost complete penetration of the rubberized coating even in a sheet four inches thick.

Although the excellent shock and vibration characteristics of rubberized fiber sheets have been recognized and exploited in conventional uses such as packing material, it has been found that pads cut from such sheet also have excellent abrasive characteristics coupled with durability. These hitherto-unrecognized characteristics of rubberized fiber make pads of such fiber an excellent replacement for the wire brush in the removal of friable coatings, and particularly asbestos residue. A pad of rubberized fiber is easy to handle, contours to moderately curved surfaces, wears well, decreases fatigue, and is less expensive to use than a brush. The grade employed is preferably the firmest grade, which is uniquely suited to scrubbing or removing friable coatings or residues thereof, and in particular asbestos residues. Rubberized fiber pads have been found to be superior to brushes for removing asbestos residues from flat or moderately contoured surfaces, particularly if the surface area is large.

In addition to increasing the productivity of labor an reducing the cost of materials, vis-a-vis wire brushes, the use of rubberized fiber pads promote safety. Rubberized pads present less of a shock hazard when they encounter an unsuspected electrical fixture or wire. Rather than flinging particles away like a brush, into the face of the workman or into a previously cleaned surface, a rubberized fiber pad tends to trap particles. The trapped particles can then be rinsed away in a bucket of water. The resilience of a rubberized pad, and the different way in which it can be held and urged against a surface, afford a workman an increased degree of flexibility in protecting his hands from accidental injury. There is less airborne contamination arising from finely fragmented fibers. Finally, rubberized fiber pads can be used in an explosive atmosphere where wire brushes might create a danger of sparking.

BRIEF DESCRIPTION OF THE DRAWINGS

FIG. 4 is a perspective view of a rubberized fiber pad;

FIG. 5 is perspective view illustrating portions of a pair of rubberized fibers from a pad; and FIG. 6 is a sectional view illustrating a rubberized fiber pad used to clean a curved or contoured surface.

DESCRIPTION OF THE PREFERRED EMBODIMENT

Although the process of the present invention may be used to remove friable coatings other than asbestos, the invention is particularly useful in the asbestos removal industry. Accordingly, an asbestos removal process will be described below as the currently-preferred embodiment of the invention.

Figure 1:
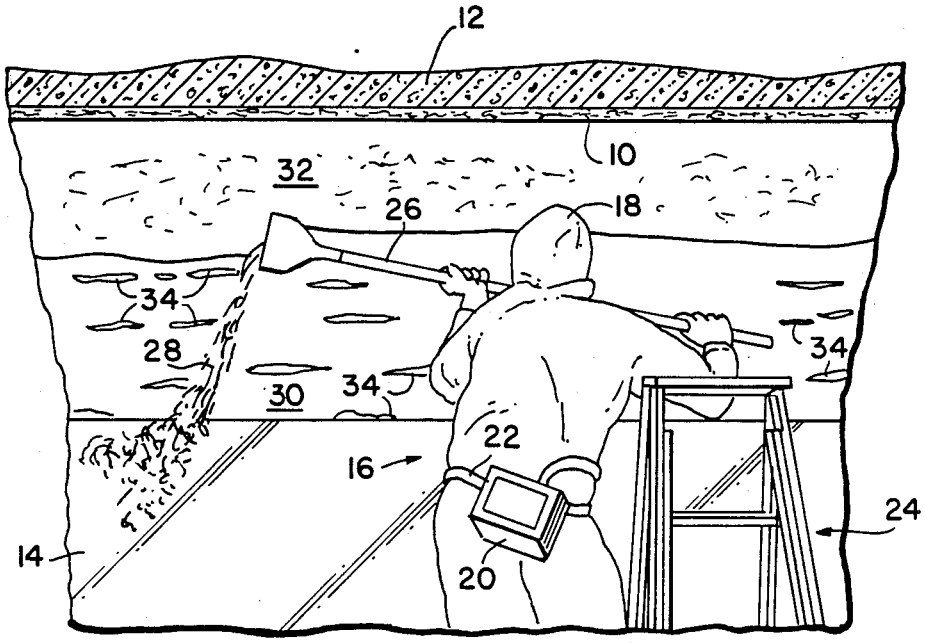
FIG. 1 is a perspective view of a workman scraping an asbestos coating from the ceiling of a structure.

An asbestos removal process in accordance with the preferred embodiment of the invention is the same as the conventional asbestos removal process described in the "Background" portion of this application up until the residue removal step. To recapitulate briefly with reference to FIG. 1, an asbestos coating 10 on a surface such as ceiling 12 is first soaked to minimize the spread of asbestos fibers, and then the coating 10 is scrapped off by a workman 16 who wears protective clothing and who receives air from a breathing apparatus 20. Inevitably, patches of asbestos residue 34 remain in the scrapped region 30.

In the present invention the residue removal step is conducted using a rubberized fiber pad 46 as illustrated in FIG. 4. Pad 46 may be three inches thick and approximately six inches wide and eight inches long, although dimensions are not critical. Such a pad has a dry weight of around two or three ounces, which is considerably less than a wire brush weighs. During use the workman preferably grasps pad 46 in the manner of a sponge, and it will be apparent that different dimensions can be employed depending upon the preferences of the work crew. Pad 46 is cut from a rubberized fiber sheet (not illustrated) which is commercially available, for example, from F. P. Woll & Company, 5216 East Comly Street, Phila., Pa. 19135, under the trademark "Wollastic Cushioning," type IV—firm. It should be noted that other densities (that is, firmness grades) are commercially available and have been found to be useful depending upon job conditions. For example it would be appropriate to scrub a delicate surface using a lighter density, which provides a more rag-like pad.

Turning next to FIGS. 4 and 5 together, pad 46 includes a tangle of rubberized fibers of various length. A typical fiber length would be 10 centimeters, for example, and a typical fiber thickness would be half a millimeter. FIG. 5 schematically illustrates portions of a pair of rubberized fibers 48 and 50 from pad 46. Each of rubberized fibers 48 and 50 includes a respective fiber core 52 and a coating 54 of natural or synthetic resin which adheres to the core. Typically coating 54 is somewhat lumpy, as illustrated, and moreover the cores 52 may have uncoated or thinly coated segments (not illustrated). In FIG. 5 the coatings 54 of rubberized fibers 48 and 50 have joined where the fibers cross to form a resilient bridge 56 connecting the fibers 48 and 50. Numerous such bridges are present in rubberized fiber pad 46 and are believed to contribute to the durability of pad 46.

It has been found that the tangle of fibers in pad 46 is not entirely random. To a slight degree the fibers in pad 46 seem to be stratified in layers parallel to surface **46*a*, corresponding to the top (or bottom) of the rubberized fiber sheet from which pad 46 was cut. Furthermore fiber ends are more prevalent at sides 46*b*, where pad 46 was cut from the original rubberized fiber sheet, than at surface 46*a*. As a result pad 46 displays an anisotropic response to objects forced against it, with sides 46*b* being more penetrable than surface 46*a*. In practical terms this means that, although surface 46*a* is tough and durable, a workman can dig his fingers and thumb into sides 46*b*. This not only makes the workman's grip on pad 46 a comfortable one, it also burries his fingertips within pad 46** and protects them from accidental scrapes.

Figure 3:
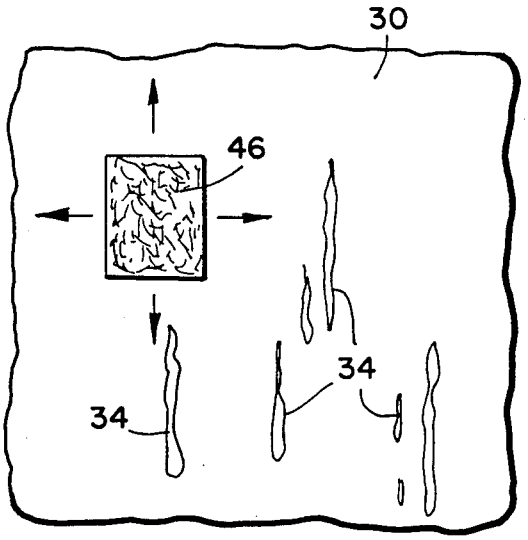
FIG. 3 is a plan view generally illustrating the use of a rubberized fiber pad to remove asbestos residue in accordance with a step in the method of the present invention.

FIG. 3 illustrates the use of pad 46 to scrub patches of asbestos residue 34 from ceiling 12. As in the conventional residue removal step, the surface is periodically sprayed to reduce airborne asbestos fibers. Unlike a wire brush, which is unidirectional in the sense that a workman typically prefers to brush back and forth rather than to sweep from side to side, there is no preferred direction when pad 46 is used. It may be scrubbed back and forth or from side to side, as illustrated schematically by the arrows in FIG. 3, or moved in a circular orbit.

FIG. 6 schematically illustrates pad 46 being used to scrub asbestos residue 34 from a curved portion of the surface of a pillar 58. It will be apparent that the resilience of pad 46 permits it to conform to the curved surface, unlike a wire brush. The ability of pad 46 to conform to a curve is particularly useful when a pipe (not illustrated) is cleaned using the bag method described in the background portion of this application.

Figure 2:
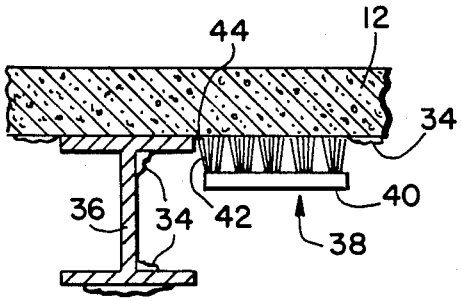
FIG. 2. (PRIOR ART)
FIG. 2 is a sectional view of a ceiling supported by an I-beam, and generally illustrates the use of a wire brush to remove patches of asbestos residue.

With pad 46, a workman can remove residue 34 from flat or moderately curved surfaces more rapidly than if a brush had been used. Nevertheless patches of residue may occasionally remain in cracks or recessed areas such as corner region 44 in FIG. 2. The residue removal step in accordance with the preferred embodiment of the present invention is completed, if necessary, by clean-up work to remove such traces of residue with a nylon brush, putty knife, damp cloth or so forth. The use of such supplemental tools for clean-up is the exception rather than the rule, however, since ordinarily pad 46 alone is sufficient in practical situations.

Following the residue removal step, an asbestos removal process in accordance with the preferred embodiment of the present invention may be concluded with an encapsulation step, as in the conventional asbestos removal technique. This is accomplished by spraying or painting a plastic-type liquid on the ceiling 10 to trap any remaining tiny asbestos fibers. New insulation or fireproofing material may then be installed if desired.

The working life of a pad 46 has not been well resolved since it is primarily a matter of choice by individual workmen. A pad 46 is discarded when a workman determines that it has become clogged or unduly frayed or otherwise less effective. A typical effective lifetime would be hours of vigorous scrubbing. Although it is difficult to compare the material cost of a pad 46 with respect to a brush, it is believed that pads 46 are less expensive. At current (1987) prices a wire brush cost about $1.50 in industrial quantities, and rubberized fiber sheets for making pads 46 cost about $0.78 per square foot. In flat areas where the residue removal can be accomplished either by a brush or a pad 46, a square foot of rubberized fiber sheet has been found on the average to last longer than a wire brush. Moreover the pads 46 do not deteriorate significantly overnight because of moisture. In short, although controlled cost studies are not available it is believed that the material cost of pads 46 is significantly less than that of wire brushes.

The major financial benefit of the invention, however, arises due to labor savings. This will be demonstrated with the aid of the following Field Test, which was conducted to confirm that, under average conditions, manpower is more productive during the residue removal step if pads 46 rather than brushes are used.

FIELD TEST

The Field Test was conducted at a building in Maryland under the supervision of a foreman experienced in asbestos removal. In the test two similar regions of decking and I-beams were marked off, each region having an asbestos coating approximately one inch thick. The regions contained equal square footage, and comparable quantities of beams, rivets, joints, fittings, and other obstructions. A two-man team of workmen was assigned to each area, each team having comparable abilities and experience in asbestos removal.

During the Field Test each team scraped its respective region and then proceeded to the residue removal step. One team used wire brushes during the residue removal step while the other team used pads 46. Upon completion the supervisor inspected the work of both teams to identify areas where further clean-up work was needed before encapsulation.

The supervisor determined that the team using wire brushes required ninety minutes to bring its area to a substantially clean condition while the team using pads 46 required only seventy minutes. The supervisor also determined that the wire brush team had left slightly more clean-up work still to do around beams and other obstructions than the rubberized pad team, but that the difference was relatively minor and constituted a small portion of the total time involved. The net result of the Field Test was that the use of pads 46 increased labor productivity by over 20%.

It will be understood that the above description of the present invention is susceptible to various modifications, changes, and adaptations, and the same are intended to be comprehended within the meaning and range of equivalents of the appended claims.

What is claimed is:

1. A process for removing deposits from a surface, comprising the step of:

scrubbing the surface with a resilient pad of rubberized fibers, the pad including a tangled plurality of elongated fibers and resinous material adhering to the fibers, the resinous material additionally forming a plurality of resilient bridges which couple adjacent fibers.

2. The process of claim 1, wherein the step of scrubbing is conducted by manually grasping the pad and rubbing the pad against the surface.

3. The process of claim 1, further comprising the step of scraping the surface before conducting the scrubbing step.

4. The process of claim 1, further comprising the step of wetting the surface before conducting the scrubbing step.

5. The process of claim 1, further comprising the step of removing any final traces of the deposits after the scrubbing step is completed.

6. The process of claim 5, wherein the step of removing is conducted using a brush.

7. The process of claim 1, further comprising the step of cutting the pad from a sheet of packing material.

8. The process of claim 1, further comprising the steps of scraping the surface and wetting the surface before conducting the scrubbing step, and removing any final traces of the deposits with a wire brush after the scrubbing step is completed, and wherein the scrubbing step is conducted manually by grasping the pad and rubbing the pad against the surface.

9. A process for removing asbestos deposits from a surface, comprising the step of:

wetting the surface by directing a liquid toward the surface;

manually scraping the surface with a scraping tool;

scrubbing the surface with a resilient pad of rubberized fibers, the pad including a tangled plurality of elongated fibers and resinous material adhering to the fibers, the resinous material additionally forming a plurality of resilient bridges which couple adjacent fibers, the scrubbing step being conducted by a workman who manually grasps the pad and rubs the pad against the surface, the workman receiving air from a breathing apparatus to protect the workman from asbestos fibers; and removing any final traces of the deposits with a wire brush after the scrubbing sep is completed.

10. The process of claim 9, further comprising the step of coating the surface with an encapsulating material, after the removing step has been completed, to trap any asbestos fibers that remain on the surface.

11. A process for removing deposits from a surface, comprising the steps of:

(a) scraping the surface;

(b) scrubbing the surface with a resilient pad cut from a sheet of packing material, the sheet having a tangled plurality of elongated fibers and resinous material at least partially coating the fibers, the resinous material additionally forming a plurality of resilient bridges which couple adjacent fibers; and (c) selectively cleaning portions of the surface where any friable material remains with a wire brush.

12. The process of claim 11, further comprising the step of repeatedly wetting the surface with a liquid while conducting steps (a), (b), and (c).

13. The process of claim 12, wherein the deposits includes asbestos and steps (a), (b), and (c) are conducted manually by a workman who receives air from a breathing apparatus to protect the workman from asbestos fibers.

14. The process of claim 13, further comprising the step of coating the surface with an encapsulating material, after step (c) has been completed, to trap any asbestos fibers that remain on the surface.

15. A process for removing an asbestos coating from a surface in a building, comprising the steps of:

(a) scraping the surface;

(b) scrubbing the surface with a resilient pad of rubberized fibers, the pad including a tangled plurality of elongated fibers and resinous material adhering to the fibers, the resinous material forming a plurality of resilient bridges which couple adjacent fibers;

(c) repeatedly wetting the surface with a liquid while conducting steps (a) and (b); and (d) coating the surface with encapsulating material to trap any asbestos fibers remaining on the surface.

16. The process of claim 15, further comprising the step of cutting the pad from a sheet of packing material.

17. The process of claim 15, wherein steps (a) and (b) are conducted manually, and further comprising the step of selectively removing any deposits of asbestos that remain after step (c) is completed.

* * * * *